US011852401B2

(12) United States Patent
Mishra et al.

(10) Patent No.: US 11,852,401 B2
(45) Date of Patent: Dec. 26, 2023

(54) ADJUSTABLE SHELF ASSEMBLY

(71) Applicant: WHIRLPOOL CORPORATION, Benton Harbor, MI (US)

(72) Inventors: Bhanu Pratap Mishra, Pune (IN); Amit Paratwar, Pimpri-Chinchwad (IN); Amol Gode, Pune (IN); Amit Kumar, Pune (IN)

(73) Assignee: Whirlpool Corporation, Benton Harbor, MI (US)

( * ) Notice: Subject to any disclaimer, the term of this patent is extended or adjusted under 35 U.S.C. 154(b) by 53 days.

(21) Appl. No.: 17/543,157

(22) Filed: Dec. 6, 2021

(65) Prior Publication Data

US 2023/0175765 A1 Jun. 8, 2023

(51) Int. Cl.
*F25D 25/02* (2006.01)

(52) U.S. Cl.
CPC ..... *F25D 25/02* (2013.01); *F25D 2325/021* (2013.01)

(58) Field of Classification Search
CPC ..... F25D 2325/021; F25D 25/021; F25D 25/025; F25D 23/067; F25D 2500/02; F25D 23/069; F25D 25/024; A47B 96/02; A47B 57/58; A47B 96/04; A47B 57/583
See application file for complete search history.

(56) References Cited

U.S. PATENT DOCUMENTS 4,032,101 A * 6/1977 Immordino ..... A47F 5/0068 248/231.31
4,949,853 A * 8/1990 Klein ..... A47B 47/02 211/186
5,577,822 A * 11/1996 Seon ..... F25D 23/069 312/401
5,642,924 A * 7/1997 Wohlrab ..... A47B 57/16 211/134
5,855,424 A * 1/1999 Hamilton ..... F25D 23/067 62/298
10,436,500 B2 10/2019 Jo et al.
2012/0024006 A1* 2/2012 Knoll ..... F25D 25/021 62/465
2013/0032559 A1* 2/2013 Gregory ..... F16M 13/02 248/225.11
2013/0038194 A1* 2/2013 Erckert ..... F25D 23/067 29/428

(Continued)

FOREIGN PATENT DOCUMENTS

DE 102011078316 A1 1/2013
WO 2005008155 A1 1/2005

(Continued)

*Primary Examiner* — Hiwot E Tefera
(74) *Attorney, Agent, or Firm* — Brooks Kushman P.C.

(57) ABSTRACT

An adjustable shelf assembly including a number of mounting members and an adjustable shelf. The number of mounting members are provided with a main body and a number of fingers extending from the main body. The number of fingers collectively define a number of interstices disposed interstitially between adjacent fingers of the number of fingers. A first finger of the number of fingers define an aperture configured to receive a shelf of the refrigerator. The adjustable shelf is configured to be inserted into one or more of the interstices so that adjustable shelf is detachably connected to one or more of the number of interstices.

20 Claims, 4 Drawing Sheets

(56) References Cited

U.S. PATENT DOCUMENTS

| | | | | |
|---|---|---|---|---|
| 2014/0042886 | A1* | 2/2014 | Baldo | F25D 23/028<br>312/405.1 |
| 2017/0299253 | A1* | 10/2017 | Wang | F25D 23/066 |
| 2019/0017741 | A1* | 1/2019 | Staud | F25D 25/024 |
| 2019/0281982 | A1* | 9/2019 | Turner | A47B 57/581 |

FOREIGN PATENT DOCUMENTS

| | | | | |
|---|---|---|---|---|
| WO | WO-2009027299 | A2 * | 3/2009 | A47B 57/58 |
| WO | 2009083353 | A2 | 7/2009 | |

* cited by examiner

ADJUSTABLE SHELF ASSEMBLY

TECHNICAL FIELD

The present disclosure relates to assemblies for translating components including drawers or trays for use in a household appliance such as a refrigerator.

BACKGROUND

Refrigerators may include a variety of storage components that may be moved between a closed position and an open position. Such components can include bins, trays, pans, or the like and can be disposed within an interior of both a fresh food compartment and a freezer compartment. These components may be mounted to an inner liner of the refrigerator by one or more tracks or guides.

SUMMARY

According to one embodiment, a refrigerator is provided. The refrigerator may include a cabinet, a first shelf member, a number of partition walls, and a number of horizontal partition walls. The cabinet may define a refrigerated compartment and the first shelf member may be coupled to an inner liner of the cabinet. The number of partition walls may be arranged substantially orthogonal to the first shelf member and each of the partition walls may define a number of apertures. The first shelf member may extend through a first aperture of the number of apertures. The number of horizontal partition walls may be configured to be inserted into a second aperture of the number of apertures to form a shelf that is spaced apart from the first shelf member.

According to another embodiment, a household appliance is provided. The household appliance may include a housing that defines a receptacle, a first shelf member, a second shelf member, a first partition wall, a second partition wall, and an intermediate shelf. The first and second shelves may be disposed in the receptacle so that the first shelf member is spaced apart from the second shelf member to form a storage space. The first shelf member may carry the first and second partition walls and the first and second partition walls may each define a number of slots. The intermediate shelf may be inserted into a first slot of the number of slots, formed by the first partition wall, and a second slot of the number of slots formed by the second partition wall, so that at least a portion of the storage space is subdivided.

According to yet another embodiment, an adjustable shelf assembly for use in a refrigerator is provided. The adjustable shelf assembly may include a number of mounting members and an adjustable shelf. The number of mounting members may each be provided with a main body and a number of fingers that may extend from the main body. The number of fingers may collectively define a number of interstices disposed interstitially between adjacent fingers of the number of fingers. A first finger of the number of fingers may define an aperture configured to receive a shelf of the refrigerator. The adjustable shelf may be configured to be inserted into one or more of the interstices so that adjustable shelf is detachably connected to one or more of the number of interstices.

DETAILED DESCRIPTION

Figure 1:
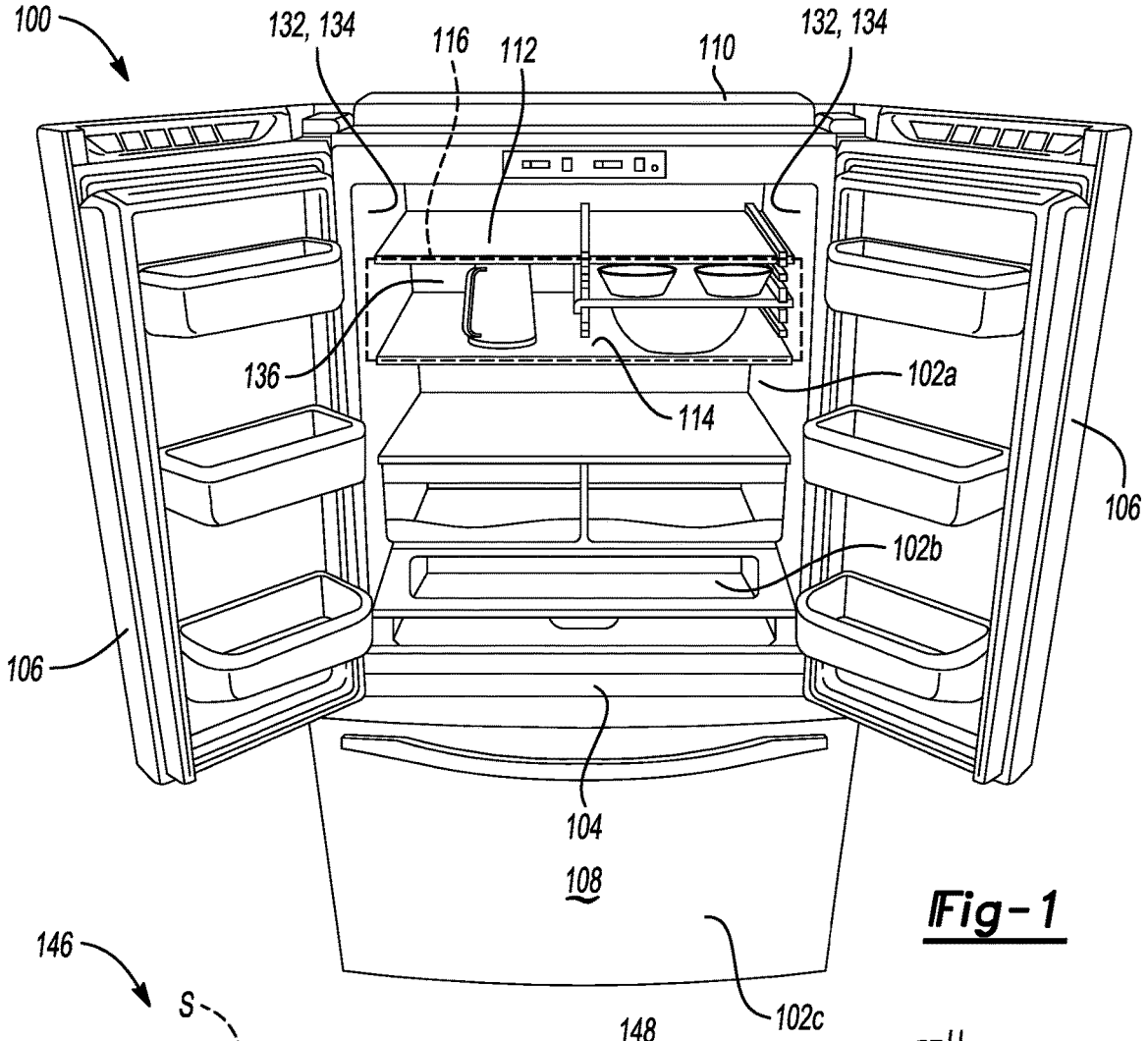
FIG. 1 illustrates a front-perspective view of an exemplary refrigerator.

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

This invention is not limited to the specific embodiments and methods described below, as specific components and/or conditions may, of course, vary. Furthermore, the terminology used herein is used only for the purpose of describing particular embodiments of the present invention and is not intended to be limiting in any way.

As used in the specification and the appended claims, the singular form "a," "an," and "the" comprise plural referents unless the context clearly indicates otherwise. For example, reference to a component in the singular is intended to comprise a plurality of components.

The term "substantially" or "about" may be used herein to describe disclosed or claimed embodiments. The term "substantially" or "about" may modify a value or relative characteristic disclosed or claimed in the present disclosure. In such instances, "substantially" or "about" may signify that the value or relative characteristic it modifies is within ±0%, 0.1%, 0.5%, 1%, 2%, 3%, 4%, 5% or 10% of the value or relative characteristic.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). The term "and/or" includes any and all combinations of one or more of the associated listed items.

Although the terms first, second, third, etc. may be used to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Refrigerators generally include a number of shelves that are fixed or detachably connected to an inner liner of the refrigerator. Such shelves are generally formed of pane of glass or translucent plastic material surrounded by a frame that may be formed of a reinforced plastic material such as Acrylonitrile butadiene styrene (ABS) or a metal frame. Refrigerator shelves are generally made of relatively stiff materials to provide sufficient rigidity and strength to support contents such as food, beverages, and food storage containers. Refrigerator shelves may be relatively heavy and adjusting the position or location of the shelves relative to one another may require a user to grasp the shelves with both hands to detach and move one or more of the shelves to one or more desired locations. Moreover, contents supported by the shelves must be removed prior to relocating the shelves to the desired locations. Clearing the shelves and repositioning the same may require significant time and effort. On the other hand, because food and beverage containers generally come in various shapes and sizes gaps may be formed between the shelves and the contents of the refrigerator. Accordingly, if a user does not reposition the refrigerator shelves, the storage space may be underutilized.

As mentioned above, known refrigerator shelves generally have a fixed or non-adjustable width. And some known shelves may extend between lateral walls of the refrigerator. Because the width of known shelves is not adjustable and portions of the same may not be lowered or raised to accommodate food and beverage items of different sizes, the storage area formed by known shelves may result in unused spaced that may otherwise be used.

Referring generally to the figures, household appliance such as a refrigerator 100 is provided. The refrigerator 100 may include a housing or cabinet 110 that may form one or more receptacles or compartments 102 such as a refrigerated compartment 102*a* or a freezer compartment 102*c*. One or more of the compartments 102 may include first shelf member 112 and a second shelf member 114 that may be arranged parallel to one another and spaced apart with respect to a vertical direction to form a storage space 116. An adjustable shelf assembly 118 may be disposed in one or more of the compartments 102 and the adjustable shelf assembly 118 may be configured to subdivide the storage space 116.

In one or more embodiments, the adjustable shelf assembly 118 may include a number of mounting members 120 such as a first partition wall 120*a* and a second partition wall 120*b*. The first and second partition walls 120*a*, 120*b* may be arranged substantially orthogonally to the first shelf member 112, the second shelf member 114, or both. The mounting members 120 may be fixed to one or more of the shelf members 112, 114. As an example, the mounting members 120 may form a number of slots 122 or apertures such as a mounting aperture 124 that may receive the first shelf member 112, the second shelf member 114 or both. The mounting aperture 124 may be sized so that one or more of the first and second shelf members 112, 114 may be inserted or slid through the mounting aperture 124. One or more of the mounting members 120 may be configured to slide along one or more of the shelf members 110, 112 to vary a width between the first partition wall 120*a* and the second partition wall 120*b*. One or more of the slots 122 may be configured to receive an intermediate shelf or adjustable shelf 126 so that the adjustable shelf 126 and one or more of the mounting members 120 subdivide the first storage space 116 into a first sub-storage space 128 and a second sub-storage space 130.

FIG. 1 generally shows the refrigerator 100. The refrigerator may be of the French-Door Bottom Mount type, but it is understood that this disclosure could apply to any type of refrigerator, such as a side-by-side, two-door bottom mount, or top-mount type. As shown in FIG. 1, the refrigerator 100 may include a number of storage compartments 102. The storage compartments 102 may include a first internal storage chamber or a refrigerated compartment 102*a*, and a freezer compartment 102*c*. The convertible storage compartment 102*b*, may be disposed between the refrigerator compartment 102*a* and the freezer compartment 102*c*. However, the compartments 102 may be arranged in a variety of arrangements. Each of the compartments 102 may be divided by a mullion or divider 104 configured to insulate the compartments from one another for independent temperature control. Additionally, one or more of the compartments 102 may be controlled to adjust in temperature such that the compartments 102 may be implemented to store frozen or fresh items.

As shown, the fresh food compartment doors are designated 106, and the freezer door is designated 108. It may also be shown that the refrigerated compartment 102*a* may only have one door 106. As example, each of the compartments 102 divided by seals that may interact with the mullions 104 to insulate the compartments 102 from each other. Accordingly, the refrigerator 100 may be flexibly implemented in a variety of configurations.

The refrigerated compartment 102*a*, the convertible storage compartment 102*b*, and the freezer compartment 102*c* may be formed by an inner liner 132 that may include one or more lateral walls 134 and a rear wall 136 that may extend between the lateral walls 134. The first and second shelf members 112, 114 may be fixed to the lateral walls 134, the rear wall 136, or some combination thereof. As an example, the first shelf member 112 may extend through the mounting aperture 124 of the first partition wall 120*a* and the second partition wall 120*b* so that the first shelf member carries the first and second partition walls 120*a*, 120*b*. The first storage space 116, represented by the dashed lines, may be defined by the first and second shelf members 112, 114, the lateral walls 134, and the rear wall 136.

Figure 3A:
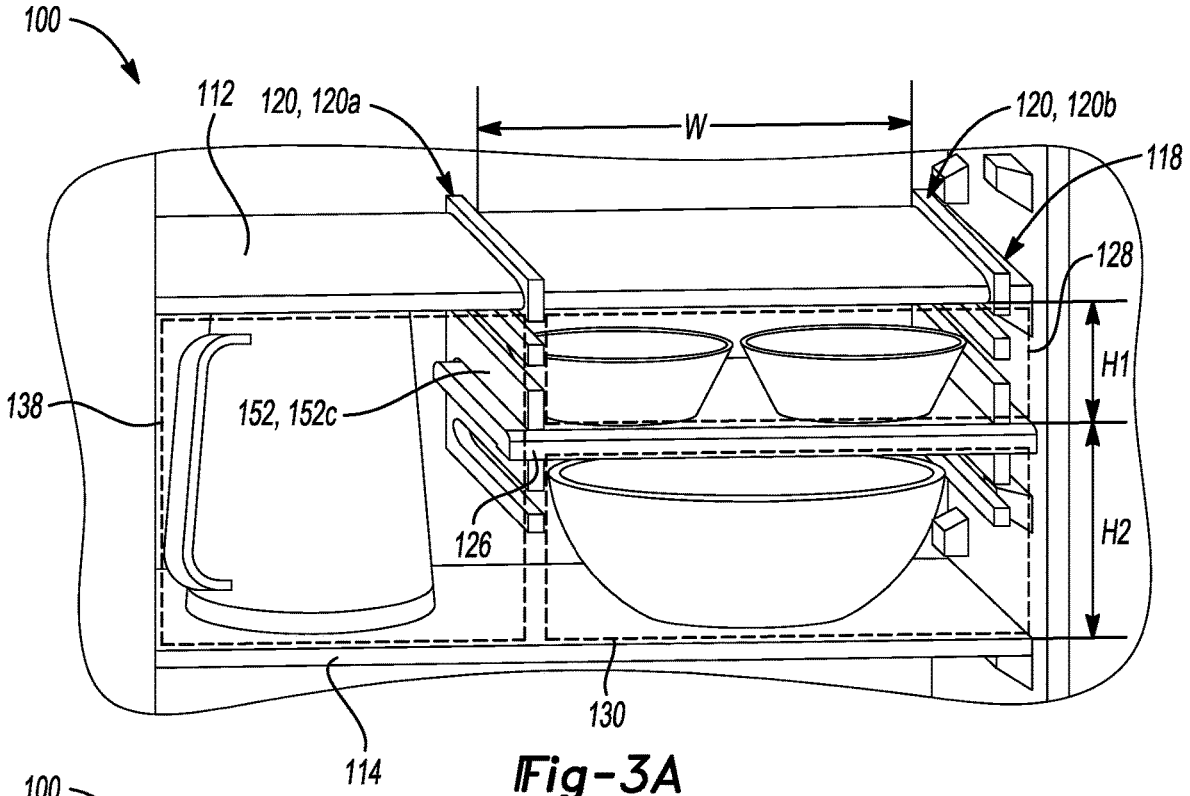
FIG. 3A illustrates a front-perspective view of a portion of the exemplary refrigerator provided with an exemplary adjustable shelf assembly.

Referring to FIG. 3A, the adjustable shelf assembly 118 may be disposed in one or more of the slots 122 to divide the storage space 116 into the first sub-storage space 128, the second sub-storage space 130, and a third sub-storage space 138 disposed adjacent to the first and second sub-storage spaced 128, 130. The first sub-storage space 128 may be sized to house smaller containers such as bowls and the second sub-storage space 130 may be sized to house a larger bowl. The third sub-storage space 138 may have a relatively larger height than the first and second sub-storages spaces so that larger containers, beverages, or utensils 144 may be disposed therein.

Figure 2:
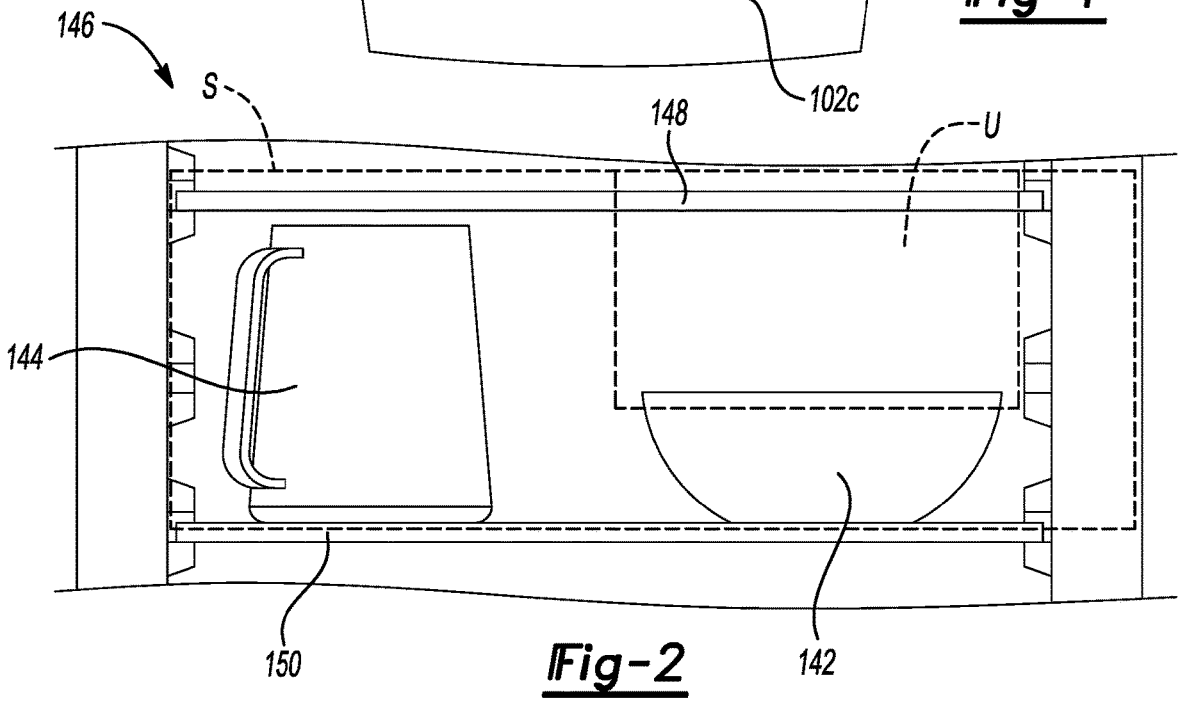
Fig-2 PRIOR ART
FIG. 2 illustrates a front-plan view of known refrigerator shelves.

FIG. 2 illustrates a portion of a prior-art refrigerator 146 provided with a first shelf 148 and a second shelf 150. The first and second shelves 148, 150 may be fixed to sidewalls of the prior-art refrigerator 146. The first and second shelves 148, 150 may form a fixed or non-adjustable storage space S and the second shelf 150 supports two food and beverage containers such as the larger bowl 142 and the pitcher 144 that are each disposed in the fixed storage space S. The fixed storage space S includes unused storage space U as represented by the dashed lines disposed above the bowl 142. If one or more portions of either the top or bottom shelves 148, 150 were adjustable, those portions may be raised or lowered so that a portion of the top shelf 148 is disposed closer to the bowl 142 than what is illustrated.

Figure 5:
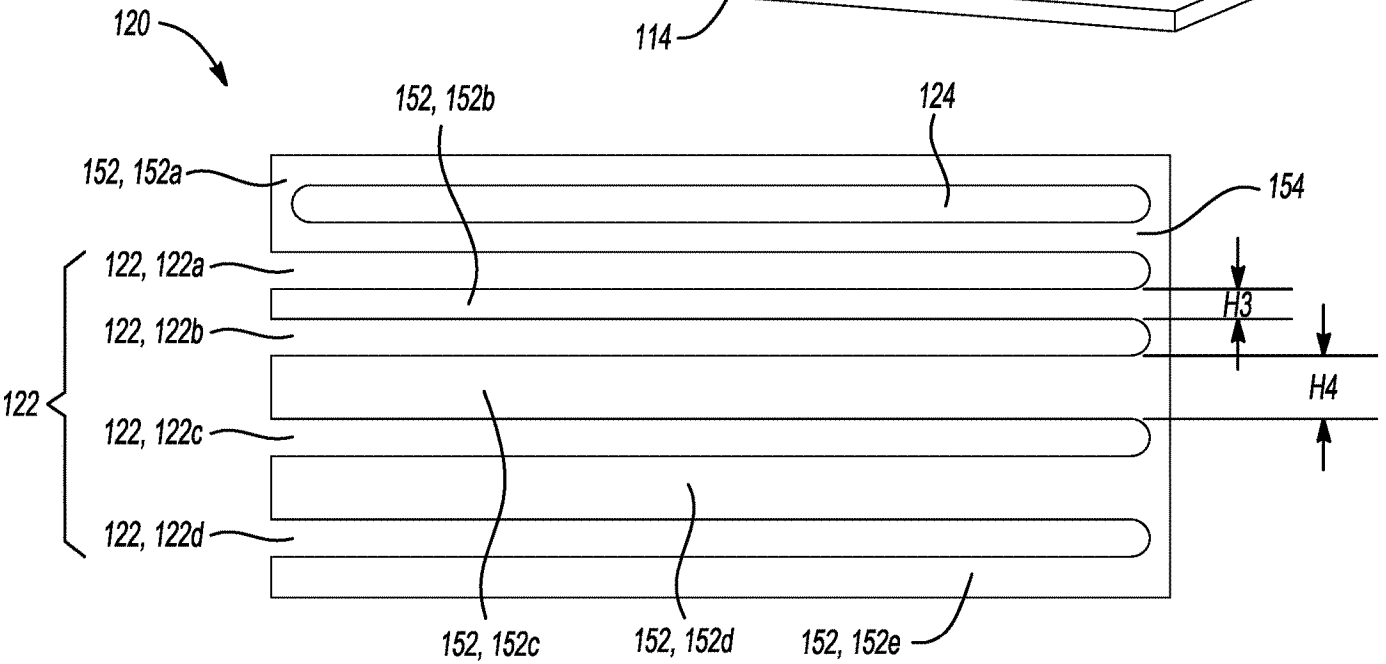
FIG. 5 illustrates a side-plan view of a portion of the adjustable shelf assembly.

FIG. 3A illustrates a front-perspective view of the refrigerator 100 and the adjustable shelf assembly 118 in a first configuration. FIG. 5 illustrates a side-plan view of the mounting member 120 according to one or more embodiments. The refrigerator 100 includes the first shelf member 112 and the second shelf member 112 that each extend between the lateral walls 134. The adjustable shelf assembly 118 may also be used with shelves 112, 114 that may be fixed to the rear wall 136 or shelves 112, 114 that do not extend between the lateral walls 134. One or more of the shelves 112, 114 may be formed of a relatively rigid plastic or polymeric material such as ABS that may have an elongation to yield or tensile strength ranging between 1.0% and 6.0%.

The adjustable shelf assembly 118 may be provided with the mounting members 120 including the first partition wall 120*a* and the second partition wall 120*b* that may be carried by the first shelf 112 or supported by the second shelf 112. The first and second partition walls 120*a*, 120*b* may define the mounting aperture 124 and the first shelf 112 may extend through the mounting aperture 124 of the first and second partition walls 120*a*, 120*b*. An inner periphery of the mounting aperture 124 (FIG. 4A) may lie along outer surfaces of the first shelf member 112 to enclose the first shelf member 112. The first and second partition walls 120*a*, 120*b* may be configured to slide along the first shelf member 112 or the second shelf member 114 to adjust a width W of the sub-storage spaces 128, 130, 138. As another example, the second shelf 114 may be inserted through the first and second partition walls 120*a*, 120*b* and the first and second partition walls 120*a*, 120*b* may be slid along the second shelf 114.

The mounting member 120 may include a main body portion 154, that may be arranged adjacent to the rear wall 136 of the inner liner 132, and a number of fingers 152 that may extend from the main body portion 154 to collectively define the interstices or notches 122. In one or more embodiments, the main body portion 154 and the bottom most finger or fifth finger 152*e* may be spaced apart from the second shelf 114. As another example, the main body portion 154 and the fifth finger 152*e* may lie along portions of the second shelf 114.

The adjustable shelf 126 may be inserted into the notches 122 such as the third notch 122*c* to form the first sub-storage space 128 and the second sub-storage space 130. The adjustable shelf 126 provides an additional shelf and the sub-storage spaces 128, 130, 138 for more efficient use of the storage space 116 (FIG. 1). The first sub-storage space 128 may have a first height H1 and the second sub-storage space 130 may have a second height H2 that may be greater than the first height H1. Because the adjustable wall 126 may be inserted into different notches 122 formed by the mounting members 120, the first and second heights H1, H2 may be varied to accommodate different sized food and beverage containers.

Figure 3B:
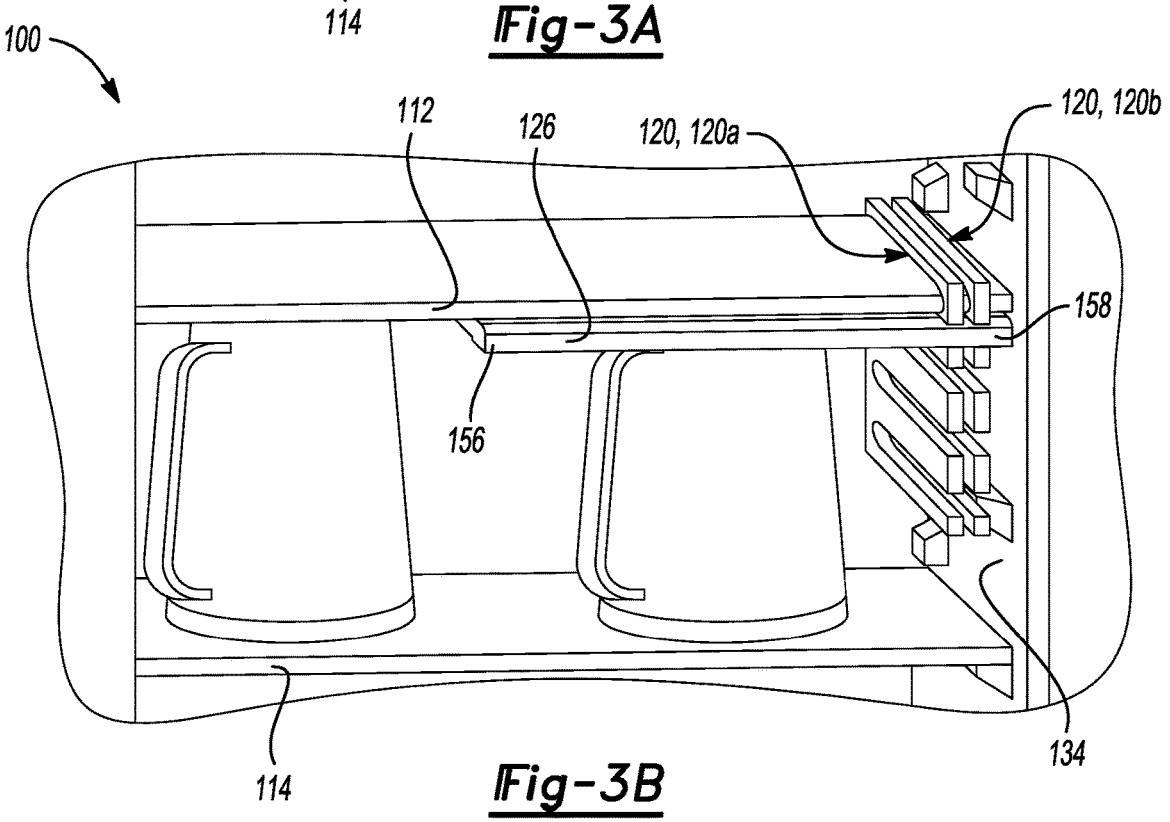
FIG. 3B illustrates a front-plan view of a portion of the exemplary refrigerator and the adjustable shelf assembly disposed in a non-use position.

Referring to FIG. 3B, under certain circumstances the adjustable shelf assembly 118 may be adjusted to a non-use configuration. In the non-use configuration, the first partition wall 120*a* may be disposed near one of the lateral walls 134 and adjacent to or in contact with the second partition wall 120*b* so maximize the width of the storage space 116 (FIG. 1). As an example, the adjustable shelf 126 may be disposed in the upper most interstices or notches 122 of the first and second partition walls 120*a*, 120*b* to maximize the height of the storage space 116 (FIG. 1). In one or more embodiments, the first and second partition walls 120*a*, 120*b* may be configured to be removed from the shelves 112, 114 by a release or hinge mechanism (not illustrated) and the partition walls 120*a*, 120*b*, and the adjustable shelf 126 may be stored within or outside of the refrigerator 100. The adjustable shelf 126 may be formed of relatively rigid material such as toughened glass so that an unsupported end 156 of the adjustable shelf lies within a common plane with a supported end 158 supported by the first and second partition walls 120*a*, 120*b*.

Figure 4A:
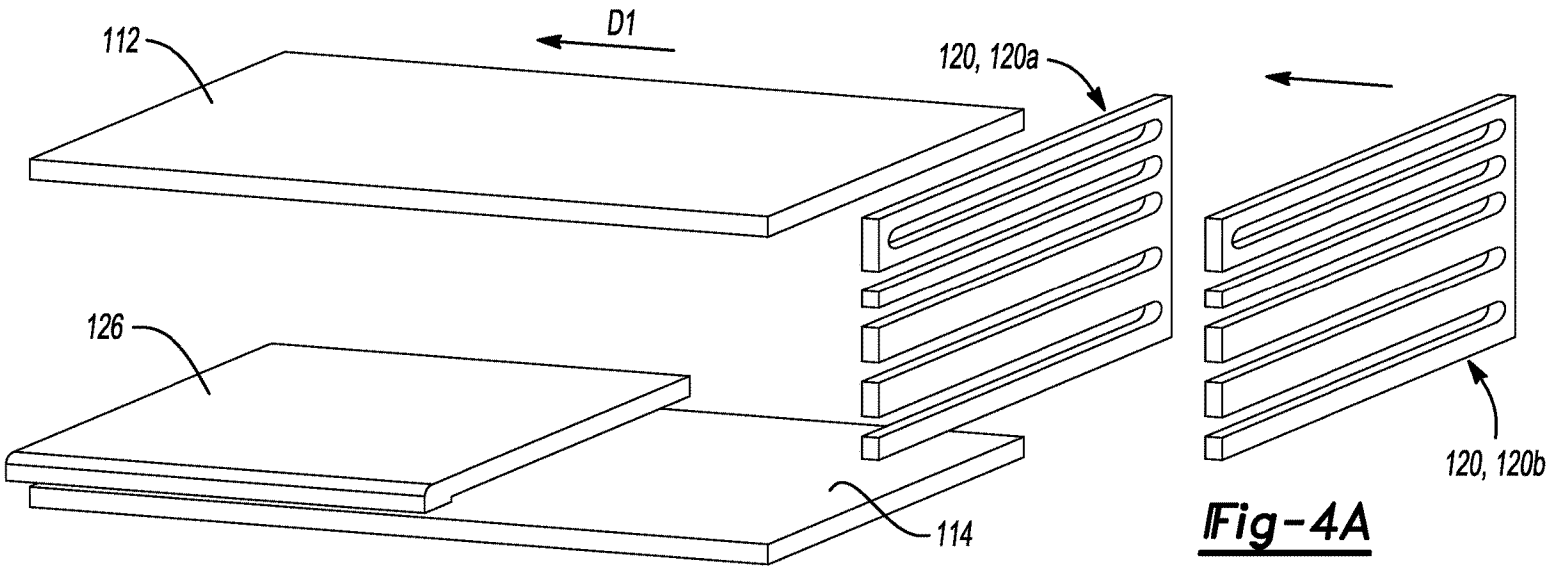
FIGS. 4A-4C illustrate an exploded view of the adjustable shelf assembly in various assembly configurations.

FIG. 4A illustrates a perspective-exploded view of the adjustable shelf assembly 118 and the first and second shelves 112, 114. The first and second partition walls 120*a*, 120*b* may be moved along the first directional arrow D1 so that the first shelf 112 slides through the mounting aperture 124 of the first and second partition walls 120*a*, 120*b*. After sliding the first and second partition walls 120*a*, 120*b* on to the first shelf 112, the first shelf 112 may carry the first and second partition walls 120*a*, 120*b*. The mounting aperture 124 and the first shelf 112 may be configured to cooperate with one another so that the position of the first and second partition walls are 120, 120*b* are fixed or held in place until a force is applied to the first and second partition walls 120*a*, 120*b* to adjust the position. As an example, the force required to move the first and second partition walls 120*a*, 120*b* may range between 2.5 N and 50 N. The adjustable shelf 126 may be placed on the second shelf 114 as the first and second partition walls 120*a*, 120*b* are assembled to the first shelf 112.

Figure 4B:
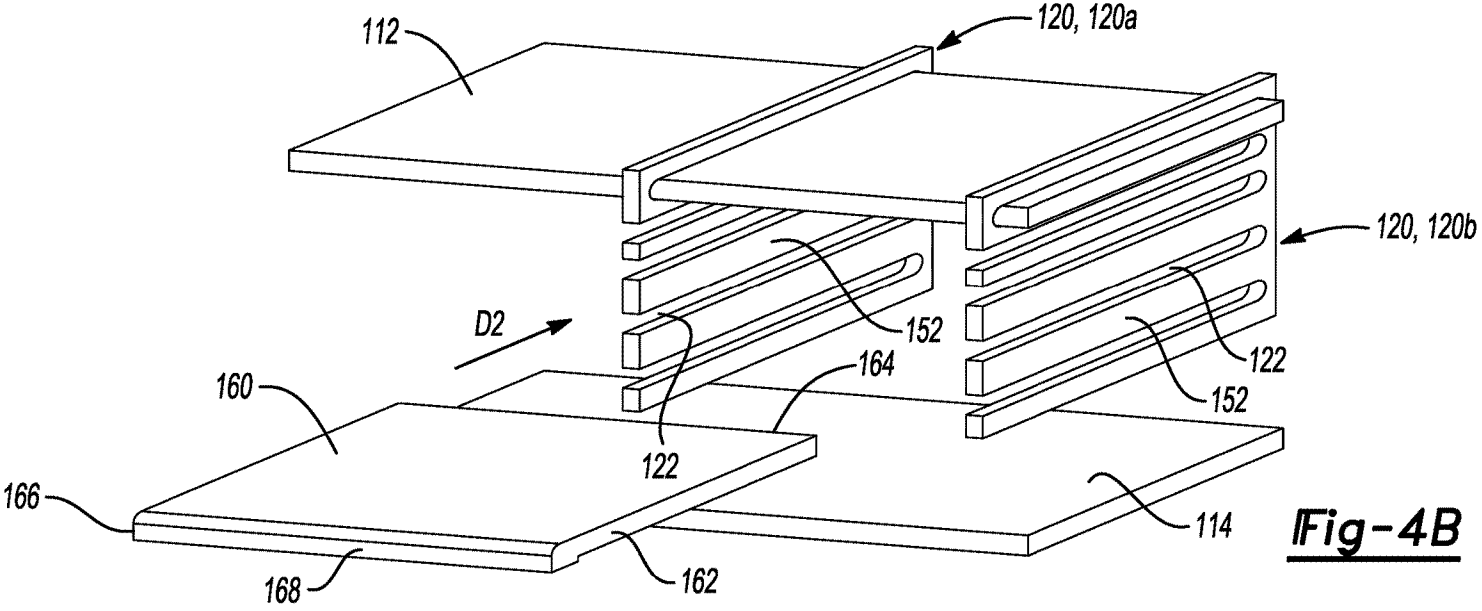

Referring to FIG. 4B, after the first and second partition walls 120*a*, 120*b* are assembled to the first or second shelves 112, 114, the adjustable shelf may be assembled to the first and second partition walls 120*a*, 120*b*. As an example the adjustable shelf 126 may be moved along the second directional arrow D2 towards one or both of the first and second partition walls 120*a*, 120*b* so that the adjustable shelf is disposed in one of the interstices or notches 122 between the fingers 152. The notches 122 and the adjustable shelf 126 may cooperate with one another to form a press-fit or force fit condition so that the adjustable shelf 126 is secured to the partition walls 120*a*, 120*b* and selectively removable by applying predetermined force as required.

The adjustable shelf 126 may include a main body portion 160 that may be configured to support food or beverage items. The main body portion may define a first edge 162 and a second edge 164, the first edge 162 may be configured to abut against or be adjacent to one of the lateral walls 134 of the inner liner 132 and the second edge 164 may be configured to abut or be adjacent to against the rear wall 136. A first lip 166 may extend from a side of the main body portion 160 that opposes the first edge 162. The first lip 166 may be configured engage one of the fingers 152 to prevent the adjustable shelf 126 from sliding to a position where the adjustable shelf is not supported by the fingers 152. A second lip 168 may extend from a side of the main body portion 160 that opposes the second edge 164. The second lip 168 may be configured to engage one or more of the fingers 152, such as a distal end of the fingers 152 to provide a rearward stop for the adjustable shelf 126. As another example, the adjustable shelf may include a protrusion or locking mechanism that may cooperate with one or more portions of the first and second partition walls 120*a*, 120*b* to constrain the placement of the adjustable shelf 126 with respect to the first and second partition walls 120*a*, 120*b*.

The adjustable shelf 126 may be have a length, extending between the second edge 164 and the second lip 168, that may be substantially equal to a length of the first shelf 112, the second shelf 114, or both. A width of the adjustable shelf 126, extending between the first lip 166 and the first edge 162 may, may be less than the width of the first shelf 112, the second shelf 114, or both. Because the adjustable shelf 126 is smaller than either the first shelf 112 and the second shelf 114, the adjustable shelf 126 may weigh less and easier to manipulate than first shelf 112 and the second shelf 114.

Figure 4C:
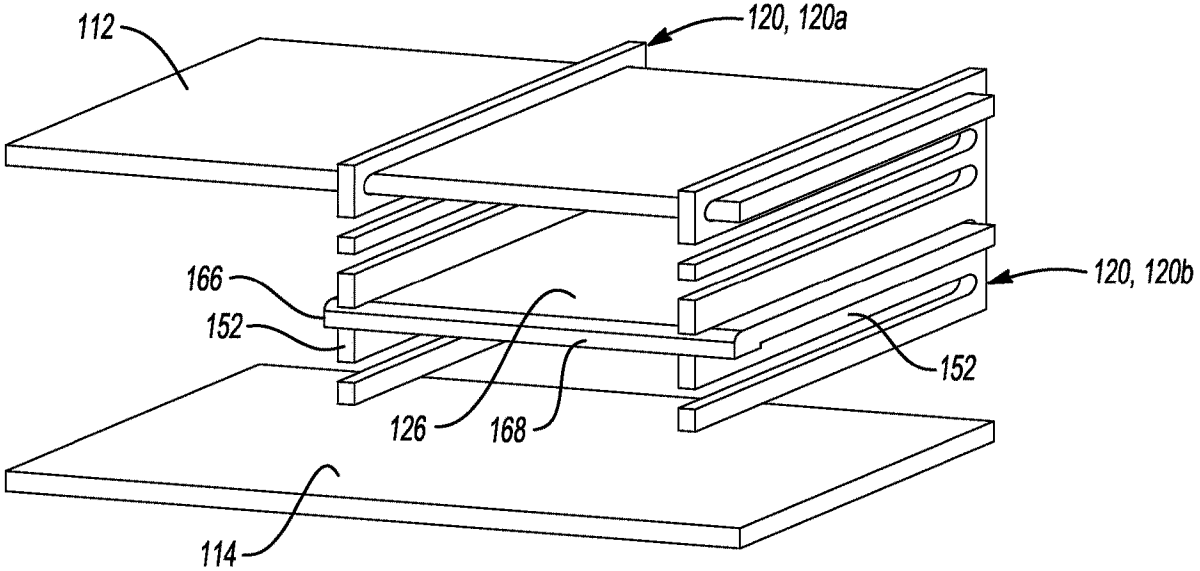

FIG. 4C illustrates the adjustable shelf assembly 118 and the first and second shelves 112, 114. The first and second partition walls 120*a*, 120*b* are carried by the first shelf 112. The adjustable shelf 126 is disposed in one of the notches 122 of each of the first and second partition walls 120*a*, 120*b*. The adjustable shelf 126 is positioned so that the first lip 166 abuts or lies against a side of one or more of the fingers 152 and so that the second lip 168 abuts or lies against distal end portions of one or more of the fingers 152.

FIG. 5 illustrates a side-plan view of the mounting member or the first and second partition walls 120*a*, 120*b*. The mounting member 120 may be formed of a material that is more elastic than the material that forms the first shelf 112, the second shelf 114, or the adjustable shelf 126, or some combination thereof. The material of the mounting member 120 may be sufficiently robust to facilitate relatively frequent removal or repositioning of the mounting member 120, adjustable shelf 126, or both, as required. As an example, the mounting member 120 may be formed of a polymeric material such as polypropylene or another suitable plastic material as required.

The mounting member 120 includes the main body 154 that may have an elongated shape extending in a vertical direction. The number of fingers 152 may include a first finger 152*a* that may be disposed at one end of the main body 154. The first finger 152*a* may form the mounting aperture 124. The mounting aperture 124 may be closed off by the first finger 152*a*. The interstices or notches 122 may be open ended and the open end may be arranged to face away from the main body 154. Some of the fingers 152 may have different heights and the interstices or the notches may have substantially the same height as one another. As an example, the second finger 152*b* may have a height H3 and the third finger 152*c* may have a height H4. The height H3 may be less than the height H4. The number of fingers 152 and the height of each of the fingers may be varied to meet different requirements for various types of shelving arrangements provided in refrigerators.

The adjustable shelf assembly 118 may be used with a number of shelving arrangements including those provided in the freezer compartment 102*c*, crisper drawers in the refrigerator compartment 102*a*, or in the convertible compartment 102*b* (FIG. 1). As another example, the adjustable shelf assembly 118 may be implemented in other household appliances not expressly illustrated or described herein. Examples of such household appliances include but are not limited to dishwashers, refrigerated drawers, and warming drawers.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A refrigerator comprising:

a cabinet defining a refrigerated compartment;

a first shelf member coupled to an inner liner of the cabinet;

a number of partition walls arranged substantially orthogonal to the first shelf member and defining a number of apertures, wherein the first shelf member extends through a first aperture of the number of apertures, and wherein the number of partition walls are configured to slide along the first shelf member; and a number of horizontal partition walls configured to be inserted into a second aperture of the number of apertures to form a shelf spaced apart from the first shelf member.

2. The refrigerator of claim 1, further comprising a second shelf member coupled to the inner liner of the cabinet, and the number of partition walls include a top edge and a bottom edge and the bottom edge is spaced apart from a top surface of the second shelf member.

3. The refrigerator of claim 1, wherein the number of partition walls include a front edge and a rear edge, the rear edge opposing the front edge, wherein the first aperture is closed by the front edge and the rear edge.

4. The refrigerator of claim 3, wherein the second aperture is a slot provided with an open end formed by the front edge.

5. The refrigerator of claim 4, wherein the number of horizontal partition walls are configured to slide from the open end towards the rear edge.

6. A household appliance comprising:

a housing defining a receptacle;

a first shelf member disposed in the receptacle;

a second shelf member disposed in the receptacle and spaced apart from the first shelf member to form a first storage space, wherein the second shelf member is configured to support a number of objects disposed in the first storage space;

a first partition wall;

a second partition wall, the first shelf member carrying the first and second partition walls, wherein the first and second partition walls each define a number of slots; and an intermediate shelf configured to be inserted into a first slot of the number of slots, formed by the first partition wall, and a second slot of the number of slots formed by the second partition wall so that at least a portion of the first storage space is subdivided.

7. The household appliance of claim 6, wherein the first and second partition walls each define a mounting aperture, wherein the first shelf member extends through the mounting aperture of the first and second partition walls.

8. The household appliance of claim 7, wherein the first shelf member is disposed above the second shelf member.

9. The household appliance of claim 6, wherein the number of slots formed by the first partition wall are arranged in a vertically extending column.

10. The household appliance of claim 6, wherein the first and second partition walls form at least a portion of a second storage space disposed in the first storage space, and wherein at least one of the first and second partition walls are configured to move along the first shelf member to vary a width of the second storage space.

11. An adjustable shelf assembly for use in a refrigerator, the adjustable shelf comprising:

a number of mounting members each provided with a main body and a number of fingers extending therefrom, the number of fingers collectively forming a number of interstices disposed interstitially between adjacent fingers of the number of fingers, wherein (i) a first finger of the number of fingers defines an aperture configured to receive a shelf of the refrigerator, (ii) the first finger has a first height and a second finger of the number of fingers has a second height, (iii) the first height and the second height are different (iv) the first finger and the second finger collectively form a first interstices, (v) a third finger and a fourth finger of the number of fingers form a second interstices spaced apart from the first interstices, (vi) the number of mounting members includes a first mounting member and a second mounting member, and (vii) the first mounting member is configured to slide along the shelf of the refrigerator towards and away from the second mounting member to adjust a width of a storage compartment of the refrigerator; and an adjustable shelf configured to be inserted into one or more of the interstices so that adjustable shelf is detachably fixed to one or more of the number of interstices, wherein (i) the adjustable shelf is configured to be inserted into the first interstices to form a storage compartment delimited by the shelf of the refrigerator and the adjustable shelf, (ii) a distance between the shelf of the refrigerator and the adjustable shelf defines a height of the storage compartment, and (iii) the adjustable shelf is configured to be inserted into the second interstices to change the height of the storage compartment.

12. The adjustable shelf assembly of claim 11, wherein the aperture is sized so that the number of mounting members are configured to slide along the shelf of the refrigerator.

13. The adjustable shelf assembly of claim 11, wherein the aperture is disposed above the number of interstices.

14. The adjustable shelf assembly of claim 11 wherein the first height is greater than the second height.

15. The adjustable shelf assembly of claim 11, wherein the adjustable shelf includes a first lip extending from a main body of the adjustable shelf, wherein the first lip is configured to engage a finger of the number of fingers as the adjustable shelf is inserted into one or more of the interstices.

16. The adjustable shelf assembly of claim 15, wherein the adjustable shelf includes a second lip extending for the main body of the adjustable shelf and arranged substantially orthogonal to the first lip.

17. A refrigerator comprising:

a cabinet defining a refrigerated compartment;

a first shelf member coupled to an inner liner of the cabinet;

a number of partition walls arranged substantially orthogonal to the first shelf member and defining a number of apertures, wherein (i) the first shelf member extends through a first aperture of the number of apertures, (ii) the number of partition walls include a front edge and a rear edge, the rear edge opposing the front edge, and (iii) the first aperture is closed by the front edge and the rear edge; and a number of horizontal partition walls configured to be inserted into a second aperture of the number of apertures to form a shelf spaced apart from the first shelf member.

18. The refrigerator of claim 17, wherein the second aperture is a slot provided with an open end formed by the front edge.

19. The refrigerator of claim 18, wherein the number of horizontal partition walls are configured to slide from the open end towards the rear edge.

20. The refrigerator of claim 17, wherein the number of partition walls are configured to slide along the first shelf member.

* * * * *